United States Patent [19]

Gregoire et al.

[11] 4,073,485

[45] Feb. 14, 1978

[54] APPARATUS FOR MAKING MULTIPLE PAGE PRINTED BOOKLETS

[75] Inventors: Clyde G. Gregoire, Bensenville; James A. Hartman, Brookfield; Milton J. Gregoire, Lombard, all of Ill.

[73] Assignee: Gregg Engineering Corporation, Lyons, Ill.

[21] Appl. No.: 758,079

[22] Filed: Jan. 10, 1977

[51] Int. Cl.[2] ..... B41F 13/56

[52] U.S. Cl. ..... 270/21; 270/72

[58] Field of Search ..... 270/1-22, 270/70-77

[56] References Cited

U.S. PATENT DOCUMENTS

| | | | |
|---|---|---|---|
| 1,662,442 | 3/1928 | Sheldon | 270/4 |
| 3,231,261 | 1/1966 | Huffman | 270/4 |

*Primary Examiner*—Edgar S. Burr
*Assistant Examiner*—A. Heinz
*Attorney, Agent, or Firm*—Kenneth T. Snow

[57] ABSTRACT

The utilization of a plurality of cooperating cylinders with externally mounted, adjustably attached universal box elements optionally containing either tucking, gripping, cutting or anvil devices to effect a folding and cutting of a multiple page booklet from a continuously printed web.

6 Claims, 7 Drawing Figures

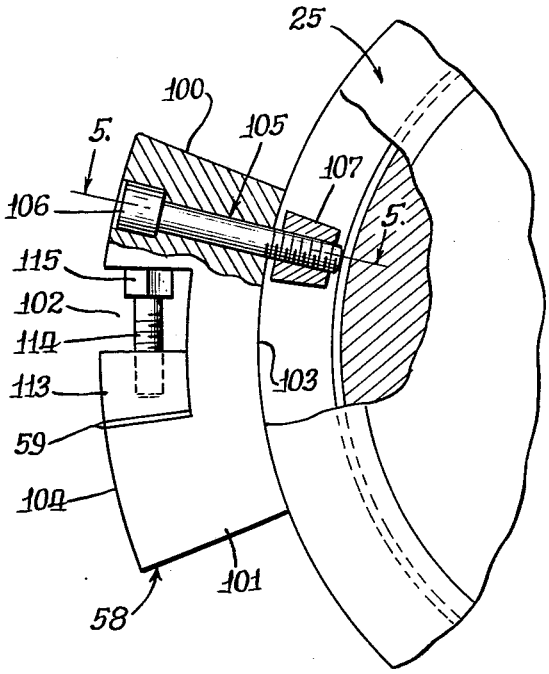
Fig. 4.
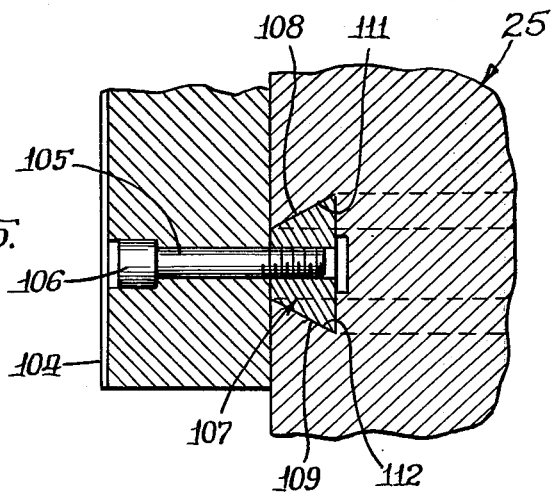
Fig. 5.
Fig. 6.
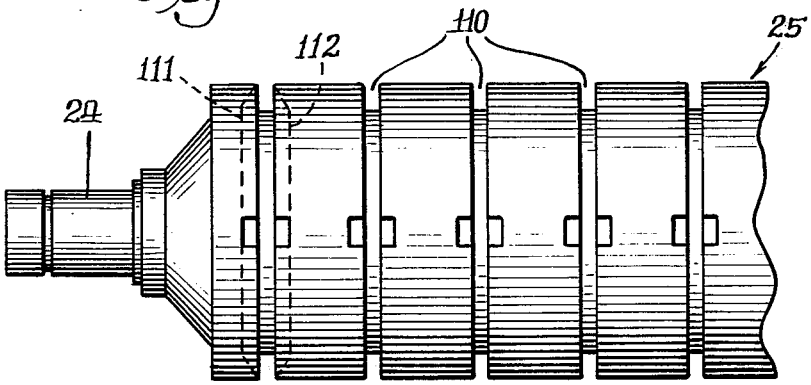

APPARATUS FOR MAKING MULTIPLE PAGE PRINTED BOOKLETS

BACKGROUND OF THE INVENTION

1. Field of the Invention

Recently printers have developed new techniques which have led to speed-up in the printing and finishing of certain jobs and including the effecting of economies in the setting up and running of these jobs. The certain printing jobs include those of multiple page books or booklets. In the past the printing of books was accomplished by printing a number of pages, collecting the printed pages in the desired arrangement, binding the groups of pages, and then shearing the bound pages to a uniform size. One of the first steps made in the modernizing of printing techniques was to print plural pages on a single continuous web of paper and with adequate room for folding and slitting the printed web was agregated into book form. However, in most instances the "book" still needed edge shearing to make the job appear finished.

The present invention contemplates the complete printing and accurate folding of the several pages in such a manner as to avoid the necessity of binding or subsequent edge shearing. This novel invention utilizes surface cooperative rolls to exclusively act on a continuously printed web to effect full and accurate folding and refolding by tucking, gripping, and cutting of the web at a speed equal to the full speed of the printer. An adequate number of rolls are employed to tuck, grip, fold, refold, and cut any desired number of pages. The present invention utilizes the mounting of universal boxes onto the external surfaces of the cooperating rolls in a manner to permit infinite position adjustment of the boxes on the several surfaces. Each universal box is equipped with a tucker, a gripper, a cutter, or an anvil and the various devices are arranged to cooperate with each other as necessary to effect a tucking, a gripping, a folding, a refolding, or a cutting to accomplish the complete making of a printed booklet of multiple pages. In previous devices tucking, gripping and cutting required rolls having pre-notched surfaces which limited the positioning of the tucking, gripping, or cutting devices. No, or very limited, adjustment was available in any prior tucking, gripping and cutting rolls so that it was almost impossible to uniformly obtain a multiple page folder with identical size pages and this resulted in the added step of having to shear the pages to uniform length.

2. Description of the Prior Art

The 1966 U.S. Pat. No. 3,231,261 to Huffman shows and describes the making of printed booklets. This device employs a number of separate stages in the making of the booklets and a description of each of these stages follows.

The first booklet making stage aggregates a plurality of preprinted continuous, superposed webs of the type having uniformly spaced holes along the sides thereof. These superposed webs are delivered to a conveyor provided with uniformly spaced apart outwardly projecting pins. The conveyor pins engage the holes of the webs to effectively and accurately align and convey the plurality of individual webs in superposed relationship as a composite multi-layer web.

The second booklet making stage provides for the optional printing of the upper surface of the top most web at a time when the webs are in superposed relationship.

The third booklet making stage provides for the transverse stitching of the plurality of superposed webs as by a row of staples.

The fourth booklet making stage provides for the longitudinal slitting of the plurality of superposed webs into a plurality of parts. This stage provides for the slitting and removal of the side edge feeding and guiding holes and the subdividing of the transverse extent of the webs into any desired number of sub-assemblies which are separately stapled.

The fifth booklet making stage provides for the transverse cutting of the plurality of superposed webs which have been previously stapled together and longitudinally subdivided. The transverse cutting is accomplished by a knife on a cylinder A and the cutting is at a location such that the staple 30 is located at a midpoint of the length of the cut-off portion.

The sixth booklet making stage provides for the guiding of the stapled sub-assembly sheets around the cylinder B.

The seventh booklet making stage provides for the gripping of the pages of the sub-assemblies by the grippers 130 and 140 on a cylinder C at the point of the staple 30. This effects a folding of the pages of the sub-assemblies about the staple.

The eighth booklet making stage provides for the stripping of the formed booklets from the folding roller C.

The ninth booklet making stage provides for the deposit of the formed booklets onto a conveyor and the collecting of the booklets in a receiving area.

The Huffman patent thus shows only a single fold and that fold being around a stapled portion of a plural number of pages. Also, there is no possible way the specially recessed rolls of Huffman will permit of possible adjustment of his cutting and folding devices and hence the Huffman pages are of fixed length and generally there is a lack of identity between Huffman and applicants' device as disclosed in this application. Applicants' device with the externally mounted universal boxes containing tucking, gripping, cutting and anvil members provides for great latitude in the user making any size and number of pages of booklet desired.

The Kalman U.S. Pat. No. 3,579,947 shows a device for producing a multiple page printed booklet from a continuously fed web. The web is folded over a former board 14 and after having preformed envelopes glued thereto the folded web is perforated and then cut into short lengths, each of which length carries an envelope. The cutting is made by knives 78 and 80 of the knife cylinder 72 cooperating with recesses in the cylinder 74. It is stated by the Kalman specification that the web cut sheets 82 are nipped at their respective midpoints by the jaws 86 and 88 of the cylinder 75 to transversely fold the sheets with a folded edge 104. Just how this is accomplished with the glued in envelope on the inside of the booklet is not shown nor described. Conveyors 96 and 97 are stated to receive the folded and glued sheets and in turn deliver them to a chopper blade 98 which functions to longitudinally fold the sheets 82. Despite the fact Kalman's device is described as making a multiple page booklet it lacks identity and function with applicants' device.

Our own prior U.S. Pat. No. 3,857,314 shows and describes the "box" like elements mounted externally of a cylinder to obtain infinite adjustability of a cutter on a cylinder. Now with such infinitely adjustable boxes being built with tuckers, grippers, cutters, and anvils a printer can set up his printing equipment to accomplish the continuous printing and folding of multiple page booklets of any size, of any fold arrangement, and of any numbers of pages. The operational rollers utilized in the present invention are constructed identically to that of the rollers shown and described in my prior patent. Each such roller is constructed with a plurality of axially spaced apart annular grooves, preferably undercut, to receive the boxes in any of an infinite number of desired positions around the full circumference of the roller. And, as in my previous patent the various boxes employed may be set on the rollers relative to one another with any desired spacing. Similarly, the boxes employed in the present invention are equipped with bolt members arranged and constructed to cooperate with wedging nuts disposed in the undercut grooves of the rollers in the same manner as in my prior patent to thus facilitate the locking attachment of the boxes in any arcuate setting around the full circumference of each such roller.

SUMMARY OF THE INVENTION

A principal object of the present invention is to provide a novel arrangement of a multiple number of operational cylinders in which each of the multiple cylinders carries on its external surface for adjustable positioning substantially similar boxes which optionally contain any one of a tucking, gripping, cutting, perforating, punching or anvil device whereby the user may effectively fold and cut continuously printed webs to form multiple page booklets of any size, of any fold arrangement and of any numbers of pages at press speeds used for the printing of such webs.

An important object of this invention is to provide a novel device as outlined in the preceding object and further containing the novel feature of accurately adjusting the box contained elements for proper relations one with the other on the multiple cylinders.

Still another important object of this invention is to provide a novel device of the preceding objects to effect a novel folding, cutting, cross perforating, cross or radial punching and refolding to accomplish a booklet of any desired fold arrangement, any number of pages, any desired portions perforated for easy removal, and of any size booklet from the printing on a single web.

Another and still further important object of this invention is to provide a novel printing press adjunct which will permit the user to fold and refold a continuously printed web in any manner to produce booklets of any desired formation and including the unusual but desirable folding of maps or charts.

Other and further important objects and advantages will become apparent from the disclosures in the following specification and the accompanying drawings.

IN THE DRAWINGS

FIG. 4 is an enlarged sectional view taken through one of the operational rollers as utilized in this invention and as shown in FIG. 1.

FIG. 5 is a sectional view taken on the line 5—5 of FIG. 4.

FIG. 6 is a front elevational view of the box holding operational rollers of this invention.

AS SHOWN IN THE DRAWINGS

Figure 1:
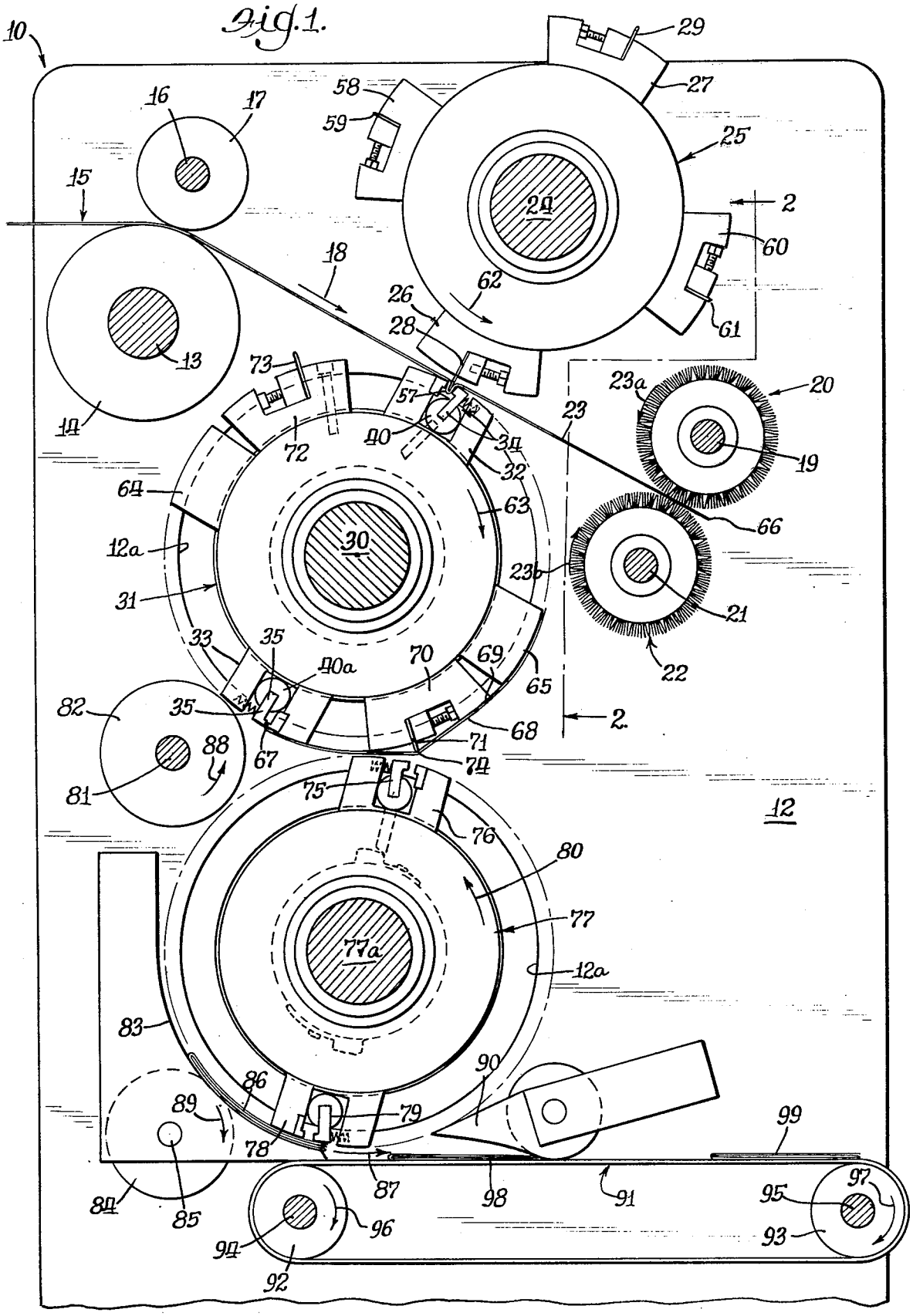
FIG. 1 is a vertical sectional view taken through a plurality of rollers arranged and equipped to form, cut, fold, and refold a multiple page printed book from a continuously printed web delivered through these rollers.
Figure 2:
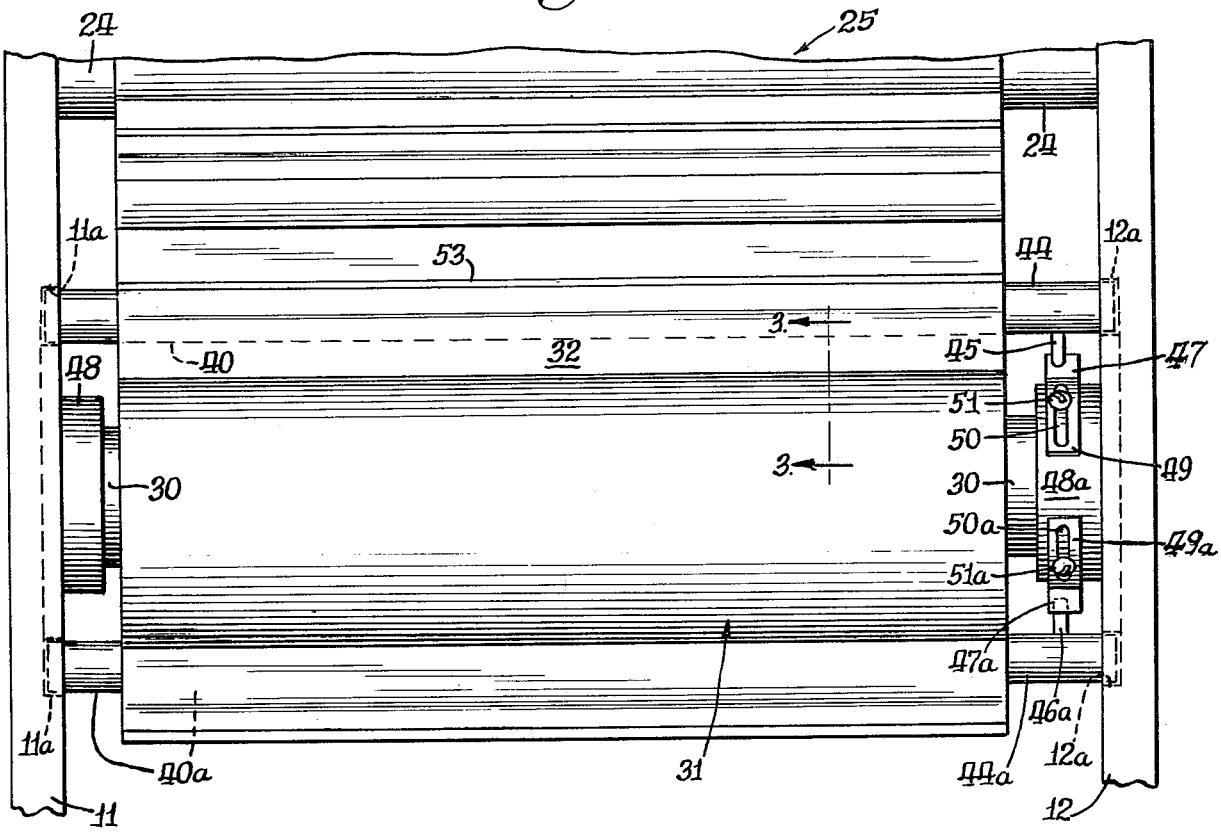
FIG. 2 is an elevational view of certain of the rollers of FIG. 1 as taken on the line 2—2 of FIG. 1.

The reference numeral 10 indicates generally a frame structure supporting the web folding and cutting mechanism of this invention. The frame 10 includes spaced apart, generally parallel side walls 11 and 12 as best shown in FIGS. 1 and 2. A shaft 13 is journalled in and extends between the spaced apart side walls 11 and 12. A roller 14 is mounted on and affixed to the shaft 13 so that when the shaft is rotated the roller will also rotate. No drive means have been shown in the drawings but it should be understood the shafts and rollers described herein are driven in the direction of the various arrows by suitable belts or gears which in turn receive rotational drive from the printing portion of the machine of this invention. The roller 14 aids in guiding and delivering a pre-printed web 15 through the book forming device of this invention. The book forming device including folding, cutting, and all other operations of this invention constitutes part of an entire printing press (not shown) which prints the continuous web 15 and thereupon delivers that printed web to the book forming portion at full press speed.

Another shaft 16 is disposed parallel to the shaft 13 and is similarly mounted in and carried between the spaced apart side walls 11 and 12. A roller 17 of somewhat smaller diameter is mounted on the shaft 16 and in cooperation with the roller 14 provides the positive means of insuring the feeding of the pre-printed web sheet 15 to the book forming mechanism of this invention. An arrow 18 indicates the direction the printed web 15 is fed into the book former.

A shaft 19, spaced apart from the shafts 13 and 16 is similarly carried in and between the side plates 11 and 12 and is provided thereover with a brush roller 20 which is rotatably driven with its carrying shaft 19. Still another shaft 21 is carried in the side plates 11 and 12 at a position relatively close to the shaft 19. A brush roller 22 is mounted on the shaft 21 and the positioning is such that the brush rollers 20 and 22 cooperate to receive and slippingly pull and support the fully fed web 15. As the web is pushed out to the nip between the brush rollers 20 and 22 by the cooperative feed rollers 14 and 17 it is yieldingly supported between the brush rollers, not crushingly but rather in a gentle yielding manner. For convenience this run of the web 15 which extends between the feed rollers 14 and 17 and the brush receiving rollers 20 and 22 is identified as run 23. The brush rollers 20 and 22 are rotated in the direction of the arrows **23*a* and 23*b* respectively and act to yieldingly support the run 23 of the web 15 in a generally straight line position from the feed rolls 14 and 17 to the brush rollers 20 and 22** while the book forming mechanisms of this invention commence their functions thereon.

The cooperative brush rollers are one form of mechanism which works at this position in the device of this invention. The brushes are not positive in their continued pulling of the web but rather slippingly pull the web to keep it in a proper position for action thereon by the operating mechanisms of this invention. It should be understood other such cooperative mechanism might also be designed to yieldingly pull and support a web end and hence applicants will refer to this device broadly as yieldingly cooperative web pulling members.

A relatively large diameter shaft 24 is spaced from the other roller shafts and again is mounted on and between the side plates 11 and 12. This shaft 24 carries what shall be termed the first operational roller 25. All of the operational rollers or cylinders of this invention, including the roller 25, are preferably machined from a single piece of metal although they are being described as having shafts carrying rollers. The operational roller carries a number of particularly selected boxes around the outer cylindrical surface thereof, each of which performs some desired task of the folding and cutting of the printed web 15. As stated above it is the operational rollers that are constructed with the plurality of axially spaced apart circumferential grooves, preferably undercut, as shown in our prior U.S. Pat. No. 3,857,314. And, similarly the boxes carrying working elements have bolt and wedge nut locking means as detailed in this same prior patent and as shown here in FIGS. 4, 5 and 6. A first such box 26 and a second diametrically disposed second box 27 are affixed to the outer cylindrical surface of the roller 25. The first box 26 carries a web tucker 28 and similarly the second box 27 carries a web tucker 29. Another large diametered shaft 30 is spaced apart from the shaft 24 and the other described shafts and again is mounted on and between the side walls 11 and 12. This large diameter shaft 30 acts to carry a second operational roller 31. Being an operational roller this too is constructed in the manner of the rollers of my prior patent. Diametrically disposed boxes 32 and 33 are affixed to the outer cylindrical surface of the second operational roller 31. Each of these boxes carries a gripper 34 and a gripper 35 respectively for the boxes 32 and 33. The operational rollers 25 and 31 have an adjoining common tangent plane at which position the preprinted web is engaged by various work elements. The locations of the boxes have been shown as in diametrically disposed pairs but this need not be the case. Merely a single box on one operational roller would be adequate providing it had a cooperative box on an adjacent operational roller. In the drawing showing in the present case the set-up is such that uniformly sized pages are made for a booklet but it should be understood that by arranging the boxes differently, pages could be made either uniform or non-uniform, with certain pages longer or shorter as desired. This means that specially formed booklets may be made with this same equipment merely by arranging the boxes differently on the operational rollers. Again, in the present device there has been shown one box following another by a quarter of the roller or 90°, but as stated this could be made any degree or distance and the operator of the device could arrange the box setting depending on where the fold or folds are to be located to produce the desired resultant booklets. Booklet page lengths may be varied up to the length of the circumference of the cylinder on which the cutting box is mounted. If it is desired to make the pages a predetermined even fraction of the whole circumference the knife holding boxes must be added to the roll in the number of divisions desired. For example, if the page length is to be exactly one-half the circumference then two cutting boxes are evenly disposed on the roller as shown. However, if the page length is to be exactly one-third the circumference then three cutting boxes must be evenly disposed around the roller. Now, if the page length is not a multiple of the roll circumference a portion of the web could be trimmed out so the remainder could be divided to make the desired page length. For details of how such trim and strip out operation is accomplished attention is directed to our earlier U.S. Pat. No. 3,893,359.

Figure 3:
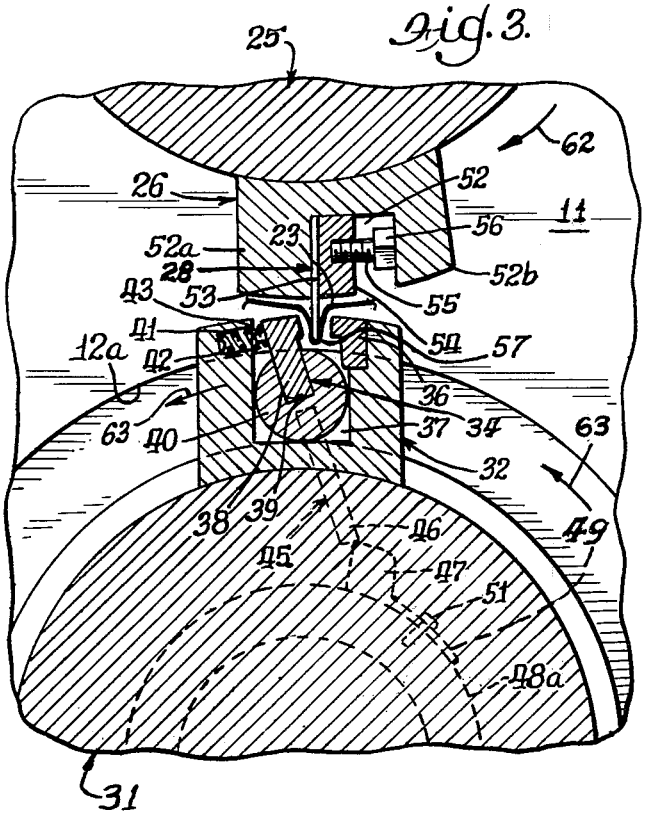
FIG. 3 is an enlarged detail sectional view taken on the line 3—3 of FIG. 2.

The enlarged view of FIG. 3 is for the purpose of clearly depicting the web gripper carried by the boxes 32 and 33 and the cooperative tuckers 28 and 29 of their respective boxes 26 and 27. A stationary jaw 36 is affixed in the upper end of one side of a generally rectangularly shaped notch or cut-out 37 in the center of the box 32. The notch 37 is open at its radial extremity and thereby may cooperate with similarly carried boxes by cooperative operational rollers such as the roller 25. A movable jaw 38 is arcuately swingable about a center 39 and lies generally in opposition to the stationary jaw 36 on the other side of the open notch 37. A rod or shaft 40 has its axis on the center 39 and is carried within and at the lower end of the notch and may rotate or rock within the notch. The ends of the rod 40 are preferably journally confined within annular bearing paths **11*a* and 12*a* respectively on the side walls 11 and 12. The movable jaw 38 is mounted in and carried by the shaft or rod 40 and projects radially therefrom. The stationary jaw 36 extends inwardly of the notch or chamber 37 and slightly over the rod 40. A spring 41 is carried within a socket 42 in the side of the box 32. A pin-like projection 43 on the back side of the movable jaw 38 telescopes within the coil spring 41. This interengagement permits the spring to urge the movable jaw toward and into abutting engagement with the stationary jaw 36 without unwarranted separation of the spring from the movable jaw 38**.

FIG. 2 best shows a lateral extension 44 of the rod 40. This extension projects into and through the space between the end of the roller 31 and the side wall 12 where it is journally carried in an annular bearing **12*a* as described above. An arm 45 is fixedly carried in the rod extension 44 and is disposed generally radially therefrom. The arm 45 has an outer free end 46 which constitutes a follower for cooperation with a cam 47. Bearings 48 and 48*a* are fixedly mounted on the inner surfaces respectively of the side walls 11 and 12 and act as journal supports for the shaft portions 30 of the second operational roller 31. The cam 47 is carried on the outer circumference of the cylindrically shaped bearing 48*a*. The cam 47 has an arcuately shaped base 49 which is adapted to snuggly engage the outer cylindrical surface of the bearing 48*a*. The arcuate base 49 is provided with an elongated slot 50 through which a set screw 51 acts to hold the cam to the bearing housing. It should be understood that the cam 47 may be arcuately adjusted on the outer surface of the bearing housing throughout the range of the length of the elongated slot 50. The cam 47 acts to engage the follower arm 46–45 and cause that arm to rock the rod 40 and thereby effect an outward movement of the movable jaw away from the stationary jaw against the action of the spring 41. The position of the opening of the jaws must coincide with the arrival of the tucker 28 and its holding box 26 on the first operational roller in tangential engagement with the gripper containing box 32 of the second operational roller. Of course, for greater cam adjustability additional threaded holes may be provided around the outer surface of the bearing 48*a* to which the cam 47 may be affixed by the set screw 51**. Thus the proper timing of the jaw operation may be accomplished, first by movement through the elongated slot and then for greater shifting, by moving the position of the cam on the bearing.

In the arrangement as shown the cam acts to open the jaws and the spring acts to close the jaws. It should be understood that the operations of opening and closing the jaws could be by means other than those utilized to show the operation.

As best shown in FIG. 3 the box 26 is provided with a rectangularly shaped notch or cut-out 52 which is open at its outward radial end. The notch 52 defines spaced apart sides 52*a* and 52*b*. The tucker 28 includes a tucker blade 53 and a back-up block 54 in the notch 52. A screw 55 is threadedly engaged in the block 54 and has its hexagonally shaped head 56 lying closely adjacent the side 52*b*. Thus when the screw 55 is threadedly withdrawn from the block 54 by rotating the hexagonal head 56 the combined block and screw act to hold the inner end of the tucker blade in fixed position within the notch 52 and having its outer end extending radially outwardly toward the second operational roller 31. As clearly shown in FIG. 3 the tucker blade 53 has engaged the run 23 of the pre-printed web 15 forming a bight 57 which is disposed between the open jaws of the gripper mechanism in the cooperating box 32 of the second operational roller 31. Continued rotation of the second operational roller causes the cam follower 46 to drop off the cam 47 and thus permit the spring 41 to close the movable jaw against the stationary jaw. Of course the first operational roller is also moving so that the box 26 leaves its momentary juncture with the box 32. The tucker blade 53 pulls or slides out of the closing jaws 36 and 38 leaving the fast closing jaws to firmly grip the bight 57 of the web run 23.

As best shown in FIG. 2 a second cam and follower is shown for the control of the operation of the gripper 35 of the diametrically disposed box 33. Inasmuch as this mechanism is the same as that shown for the gripper 34 of box 32 it will not be described again in detail. However, to make the disclosure complete the elements will be referred to by suitable identifying numerals. The rod for gripper 35 is 40*a* and its lateral extension is 44*a*. A follower arm 46*a* radially projects from the rod extension 44*a* and is adapted to intermittently engage a cam 47*a*. The cam 47*a* is provided with an arcuate base 49*a* having an elongated slot 50*a* therein. This cam 47*a* and its base 49*a* is mounted on the same bearing housing 48 but at a generally diametrically disposed position. A set screw 51*a* passes through the elongated slot 50*a* and is threaded into the bearing housing 48 to effect a fixed arcuate adjusted positioning of the cam thereon when the screw is drawn up tightly.

As best shown in FIG. 1 the roller 25 is equipped with another box 58 on the cylindrical surface thereof which is located midway between the tucker carrying boxes 26 and 27. It is this box 58 which is shown in detail in FIGS. 4 and 5 and will be subsequently described to illustrate the attaching means of the box to an operational roller for infinite arcuate adjustment therearound. The box 58 is provided with a radially disposed knife 59 for the purpose of cutting the pre-printed web 15 in a manner to be described. The roller 25 is also provided with still another box 60 disposed diametrically opposite the box 58. Thus the box 60 is positioned midway between the tucker boxes 27 and 26. The box 60 is equipped with a radially disposed knife 61, again for the purpose of cutting the pre-printed web 15. The arrow 62 indicates the direction of rotation of the first operational roller 25 and similarly the arrow 63 indicates the direction of rotation of the second operational roller 31. The arrows 62 and 63 are shown in both of FIGS. 1 and 3. With the gripper 34 now holding the run 23 of the web 15, and the roller 31 rotating in the direction of the arrow 63 the web is pulled by its bight 57 around the outer surface of the roller. Another box 64 is provided on the outer surface of the roller 31 at a location midway of boxes 32 and 33. This box 64 acts as an anvil to abuttingly receive the radially disposed knife 59 of the box 58 on the first operational roller 25. These boxes 58 and 64 abut and are tangentially arranged one with the other when the box 32 has moved with the web one-quarter revolution. When this occurs the knife 59 acts to cut through the web run 23 and continued rotation of the operational rollers including roller 31 brings the once folded web run with its bight 57 leading the way to a position the same as that shown for box 33. The roller 31 is also provided with still another box 65 which is disposed diametrically opposite the box 64 and it too constitutes an anvil which on rotation of the rollers 25 and 31 comprises the cooperative means for the radial knife 61.

The first book forming operation occurs after the feed out of the web run 23 to the brush rollers 20 and 22. The tucker 28 places the bight 57 of web run 23 in the open jaws 36–38. Continued rotation of the rollers 25 and 31 causes the cam follower rod 45 and particularly its end 46 to drop off the cam 47. This permits the coil spring 41 to expand and push the swingable jaw 38 in an arcuate swinging movement around its center 39 and thus pinch the web bight against the stationary jaw 36. In a quarter turn of the rollers 25 and 31 the boxes 58 and 64 meet at the tangential juncture between the rollers. At this point the knife 59 in the box 58 reacts against the anvil surface of the box 64 to cause a severing of the web run 23. At this position in the operation the box 32 will have been rotated so that it would occupy the space where the anvil box 65 is initially located as shown in FIG. 1. The box 32 with its clenched jaws 36 and 38 pulls the web bight 57 around the cylindrical wall of the roller 31 with the end 66 of the web which was preliminarily engaged by the cooperatively yielding brush rollers 20 and 22 folded over against the other end of the web as determined by the cutting thereof by the cooperative knife 59 and anvil 64.

Another quarter revolution of the roller 31 puts the box 32 in the position as shown by the original position of the box 33. Let us assume the operation had been previously started and the jaw mechanism of box 33 had picked up a previously formed web bight 67. The bight 67 with its trailing web parts 68 and 69 lying one on another as shown in FIG. 1 cover a portion of the cylindrical surface of the roller 31. Another box 70 is carried on the roller 31 at a position between the anvil box 65 and the gripper box 33. A tucker mechanism 71 is carried in the box 70 and has all of the elements of the tucker as shown and described for the box 26 as shown in detail in FIG. 3. A diametrically disposed box 72 on the roller 31 is also equipped with a tucker mechanism 73. As shown in FIG. 1 the tucker 71 is pushing a new bight 74 in the overlapped ends 68 and 69 of the once folded web into a jaw gripper mechanism 75 which is mounted in a similar box 76 in still a third operational roller 77. The roller 77 is provided with shaft-like end portions 77*a*. Again, this operational roller 77 is constructed in the same manner as the rolls in our earlier U.S. Pat. No. 3,857,314, identified above. A diametrically disposed box 78 is mounted on the third roller 77 and carries a jaw gripping mechanism 79. It should be understood that all of the jaw gripping devices are identical in construction to that shown in detail in FIG. 3. The arrow 80 indicates the direction of rotation of the third roller 77 and it is evident that when the boxes 70 and 76 are in tangential relationship the bight 74 will be fully inserted into the open jaws of the gripper 75 and continued rotation of the rollers in their same directions as previously indicated will cause an immediate closing of the gripper 75 onto the bight 74 and a resultant pulling of the once folded web around the roller 77 to now effect a second folding of the web part with double sheets lying one on top of the other as the closed jaws 75 move downwardly around the roller 77. The gripper means 75 is cam operated in the same manner as the gripper means 34 in the box 32 so that immediately upon the double bight 74 being inserted into the open jaws 75 the cam and its follower separate allowing a spring in the box 75 to close the jaw means and thereupon pull the bight 74 with its double lapped web over the top and down the back side of the roller 77.

A shaft 81 is carried in and extends between the side frame members 11 and 12 at a position near the juncture between the rollers 31 and 77. A roller 82 is mounted on the shaft 81 and acts as an initial guide for the now four page booklet of the twice folded section of web run. The roller 82 is preferably rotatably driven to give impetus to the smooth movement of the four page booklet around the cylindrical surface of the third roller 77. A stationary guide 83 arcuate in shape, is utilized to further guide the movement of the folded booklet around the roller 77. Another roller 84 is positioned near the bottom of the third operational roller 77 at substantially the mid-point of the stationary guide 83. The roller 84 is carried on a shaft 85 to aid in directing the booklet and turning the corner around the underside of the roller 77. A four page booklet 86 formed in the manner just described is shown as it is being released from the jaw means 79 and moving in the direction of the arrow 87. An arrow 88 shows the direction of rotation of the roller 82 to tend to squeeze out air trapped in the formed booklets. Roller 82 may be rotated in a reverse direction if that is found to be desirable. The arrow 89 shows the direction of rotation of the roller 84. All of the mechanisms just described act to confine and facilitate the feeding of the newly formed four page printed booklet around the bottom side of the roller 77 where it is to be discharged. A plow device 90 is carried on the side frame members 11 and 12 and acts to positively strip the newly formed booklets from the surface of the roller and prevents the booklets from adhering to and riding up the far side of the roller 77.

An endless belt 91 carried on spaced apart rolls 92 and 93 is arranged and constructed to receive the discharged booklets and carry them to a receiving location. The rolls 92 and 93 are carried respectively on shafts 94 and 95 which in turn are mounted on and extend between the side walls 11 and 12. The arrow 96 indicates the direction of rotation of the roller 92 and similarly the arrow 97 indicates the direction of rotation of the roll 93. A completed, printed, folded and cut booklet 98 is shown on the top surface of the endless belt 91 and moving in a rightward direction as viewed in FIG. 1 and shown by the arrow 87. Another finished booklet 99 is shown at the outer end of the endless belt 91 and about to be discharged therefrom for falling into a receiving stack.

FIGS. 4, 5 and 6 disclose a portion of the material in our prior U.S. Pat. No. 3,857,314 that is being utilized in the present application. As best shown in FIG. 4 the box 58 with its knife element 59 comprises generally spaced apart radially disposed legs 100 and 101 which together define a central radially opening notch 102. An inner curved surface 103 of the box 58 is identical to the outer curvature of the operational roller 25 and thus fits snuggly against that outer surface of the roller. The box 58 has an outer curved surface 104 defined by the outer surfaces of the spaced apart legs or side members 100 and 101. The curved surface 104 is generally concentric to the inner curved surface 103.

The knife holding box 58 is fastened to the surface of the operational roller 25 by means of bolts and wedging nuts. One such bolt 105 passes radially through the side leg portion 100 of the box 58. The box in the present instance is generally U-shaped as defined by the spaced apart legs 100 and 101 and the included rectangularly shaped center notch 102. A head 106 of the bolt 105 is positioned at the top of the bolt 105 and a cooperative wedging nut 107 threadedly engages the lower end of the bolt 105. The wedging nut 107 is generally of a wedge shape as shown in FIG. 5. Spaced apart sides 108 and 109 of the nut 107 are inclined or tapered inwardly in a direction toward the head 106 of the bolt 105. As best shown in FIGS. 5 and 6 the operational roller 25 is provided with a plurality of annular slots 110 spaced generally uniformly at intervals along the length of the roller in the direction of the axis of rotation of that roller. The slots 110 enable the various boxes utilized to be fixedly mounted in any desired arcuate position around the outer cylindrical surfaces of any of the operational rollers of this invention. Each of the annular slots 110 is preferably undercut as shown by the angularly inclined walls 111 and 112 in FIG. 5 of the drawings. The inclined sides 108 and 109 of the wedging nut 107 have angles substantially identical to the side angles 111 and 112 of the annular grooves 110. Thus when the bolt 105 and nut 107 are drawn tightly together the nut wedge 107 becomes locked in the slot 110. This acts to hold the box in any desired adjusted position.

The notch or recess 102 in the top side of the box 58 is adapted to receive the knife 59 so that the sharpened end thereof is at its radial outer end. A back-up block 113 is adapted to abut against the knife 59 and hold the flat surface of the knife in abutting engagement with the inner surface of the leg 101 which defines the rectangularly shaped notch 102 at one end thereof. A bolt 114 is threadedly engaged with the block 113 and this bolt is utilized to effect a tightening of the knive element 59 against the inner surface of the U-leg 101. The bolt 114 is provided with a hexagonally shaped head 115 to which a wrench may be applied and the bolt 114 rotated. After the radial extension of the knife 59 is preliminarily fixed the blade is tightened in its adjusted position. Such tightening is accomplished by putting a wrench on the hexhead 115 of the bolt 114 and turning the bolt in a direction to cause the bolt to back out of the block 113. The bolt head 115 is now pushed against the spaced apart U-leg 100 thereby reacting and causing the knife blade 59 to be wedged in its fixed adjusted position against the opposing U-leg 101.

All of the operational rollers 25, 31 and 77 of this invention are requipped with undercut annular grooves 110 as shown in the drawing illustration in FIG. 6 for roller 25. With this construction the various boxes may be mounted in any desired arcuate position on the external surface of any one of these operational rollers.

Figure 7:
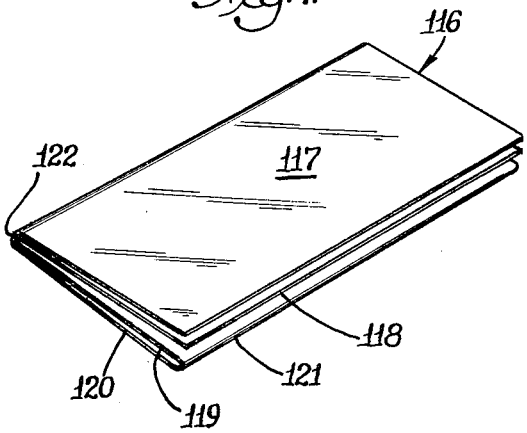
FIG. 7 is a perspective view of a booklet folded and cut with the device of this invention.

FIG. 7 shows an enlarged perspective view of a completed booklet 116. The booklet 116 comprises a top sheet 117, a second sheet 118, a third sheet 119 and a fourth sheet 120. A single fold 121 joins the third sheet 119 with the fourth sheet 120. A double fold 122 joins the first sheet 117 and the fourth sheet 120 and further joins the second sheet 118 and the third sheet 119. Obviously if it should be desired to eliminate the closure between sheets 119 and 120 by reason of the fold 121 a fourth operational roller could be used in the general area of the booklet guiding roller 82 and carrying a cutting box such as those shown at 58 and 60 on roller 25 and depicted in FIGS. 1, 4 and 5. This added knife box on an additional operational roller would of course require an anvil box on the third roller 77 at a position between the boxes 76 and 78. Such an operation would trim the edges of the booklet uniformly and make for a finished booklet without further trimming or binding operations and at the same time make the booklet fully openable from one side.

The booklet forming device of this invention is most versatile and permits a printing establishment to utilize a number of operational rollers to effect a gripping, tucking, cutting perforating, punching and folding as desired at the full speed of a continuously printed web. It should be apparent that as the first section of web such as the run 23 is severed from the remainder of the web a new run is immediately fed out and yieldingly pulled by the cooperative brush rollers 20 and 22 for the formation of a succeeding booklet. And, additional operational rollers may be employed to accomplish further folds or other operations on the printed booklet. One of the basic principles in the successful utilization of such a booklet forming device is the use of the various similar boxes, each holding a working element, and each adjustably positioned as desired on the operational rollers. This gives a printer using this equipment many options whereas previously such a printer was confined in his usage of all of his equipment to just one standard job. Although only a four page booklet is discussed, more pages could be obtained by having the preprinted single web folded over upon itself either once, twice, or more times as desired before it is delivered to the double roll folder of this invention. Thus, if the web introduced was two sheets thick by reason of a single fold then the resultant booklet would be 8 pages and similarly if the web introduced was three sheets thick by reason of it being twice single folded then the resultant booklet would be 12 pages. And, if the web introduced was four sheets thick by reason of the web being folded once and then folded in half the resultant booklet would be sixteen pages. Obviously the number of booklet pages could be further increased by increasing the sheets comprising the incoming web to the folder of this invention.

We are aware that numerous details of construction may be varied throughout a wide range without departing from the principles shown herein and we therefore do not propose limiting the patent granted hereon otherwise than as necessitated by the appended claims.

What is claimed is:

1. An apparatus for making multiple page booklets from a continuously printed web comprising a frame support, a pair of cooperative rotatably driven feed rollers carried on said frame support, a spaced apart pair of yieldingly cooperative web pulling members carried on said frame support, said feed rollers adapted to receive a continuously printed web and deliver it to the spaced apart pair of yieldingly cooperative members for pulling and supporting an end of said web, first and second operational rollers carried on said frame support at a location generally between said feed rollers and said yieldingly cooperative members, said first and second operational rollers having tangentially joining surfaces coincident with the path of the printed web disposed between the feed rollers and the pair of yieldingly cooperative web pulling members, a plurality of similarly sized and shaped working boxes, means for adjustably positioning said working boxes about said operational rollers, the first of said operational rollers having one such box equipped with a web tucking member and having another such box equipped with a knife member, and the second said operational roller having one such box equipped with a web gripping means for cooperation with the web tucking member of the one such box of the first of said operational rollers, and the second of said operational rollers having another such box equipped with an anvil for cooperation with the knife member of the another such box of the first of said operational rollers, and a third operational roller carried on said frame support having a tangential joining surface with the second of said operational rollers, said third operational roller having one such box equipped with a web gripping means, and said second operational roller having still another such box equipped with a tucker member arranged for cooperation with the one such box equipped with the gripping means on the third operational roller, and cam means associated with said frame support and said boxes equipped with said gripping means to effect an intermittent opening of said gripping means to receive a bight of the printed web by said tucker members, and means closing said gripping means on said web bight, whereby the continuously printed web is cut and folded into a multiple page booklet at printing press speeds as it is moved in a path around the operational rollers having the working boxes thereon.

2. A device as set forth in claim 1 in which said pair of yieldably cooperative web pulling members comprise cooperative rollers having brush outer surfaces.

3. A device as set forth in claim 1 in which there is included booklet stripping means associated with the third operational roller and conveyor means to receive and remove the stripped booklets from the third operational roller.

4. A device as set forth in claim 1 in which each of said operational rollers is equipped with an additional working box diametrically disposed to each of the previously recited boxes and each such additional box equipped with the same element which it diametrically opposes.

5. A device as set forth in claim 1 in which each of the several gripping means comprises a box with a radially open ended rectangularly shaped notch, a stationary jaw positioned on one side of said radially open notch, a rod disposed in the notch for rocking movement about its longitudinal axis, a movable jaw affixed in said rod in a radial manner and projecting therefrom to cooperate with said stationary jaw at a position near the radially open end of said notch, means arranged and constructed to intermittently open and close said movable jaw with said stationary jaw by a rocking action of said rod about its axis.

6. A device as set forth in claim 1 in which each of the several gripping means comprises a box with a radially open rectangularly shaped notch, a stationary jaw positioned on one side of said radially open notch, a rod disposed in the notch for rocking movement about its longitudinal axis, a movable jaw affixed in said rod in a radial manner and projecting therefrom to cooperate with said stationary jaw at a position near the upper end of said notch, spring means carried in said box and arranged and constructed to normally close said movable jaw with said stationary jaw by a rocking action of said rod about its axis, said rod having an end extension, a cam follower arm affixed in said rod extension in a radial direction, a cam carried on said frame support adjacent said cam follower arm, and said cam adjustably positioned to provide for the intermittent opening of said movable jaw by rocking said rod against the action of the spring means.

* * * * *